US009663904B2

(12) United States Patent
Thieme et al.

(10) Patent No.: US 9,663,904 B2
(45) Date of Patent: May 30, 2017

(54) TEXTURE CURING MACHINE AS WELL AS METHOD FOR THE SUBSEQUENT TREATMENT OF A FRESHLY PRODUCED CONCRETE LAYER

(71) Applicant: Wirtgen GmbH, Windhagen (DE)

(72) Inventors: Holger Thieme, Vettelschoss (DE); Cyrus Barimani, Konigswinter (DE)

(73) Assignee: Wirtgen GmbH (DE)

( * ) Notice: Subject to any disclaimer, the term of this patent is extended or adjusted under 35 U.S.C. 154(b) by 63 days.

(21) Appl. No.: 14/707,375

(22) Filed: May 8, 2015

(65) Prior Publication Data

US 2015/0337501 A1 Nov. 26, 2015

(30) Foreign Application Priority Data

May 23, 2014 (DE) ..... 10 2014 209 880

(51) Int. Cl.
*E01C 11/24* (2006.01)
*E01C 23/02* (2006.01)
(Continued)

(52) U.S. Cl.
CPC ..... *E01C 11/24* (2013.01); *E01C 19/43* (2013.01); *E01C 23/025* (2013.01);
(Continued)

(58) Field of Classification Search
CPC ..... E01C 23/025; E01C 23/028; E01C 23/09; E01C 23/20; E01C 23/065; E01C 23/07;
(Continued)

(56) References Cited

U.S. PATENT DOCUMENTS 3,605,579 A * 9/1971 Heltzel ..... E01C 19/43 404/89
3,775,018 A 11/1973 Barton
(Continued)

FOREIGN PATENT DOCUMENTS

DE 102011003271 A1 8/2012
EP 1841637 A1 10/2007

OTHER PUBLICATIONS

Ex. A: "GOMACO TIC-5600" Brochure, 4 pp., 2013.
Ex. B: "GOMACO Texturing/Curing Machines" Brochure, 8 pp., 2006.

*Primary Examiner* — Abigail A Risic
(74) *Attorney, Agent, or Firm* — Lucian Wayne Beavers; Patterson Intellectual Property Law, PC

(57) ABSTRACT

In a texture curing machine for the subsequent treatment of freshly produced concrete layers of a predetermined width, in particular concrete roadways extending longitudinally in the direction of travel, comprising a machine frame supported by ground-engaging units, with no less than one texturing device movable transverse to the working direction for applying a texture, by means of multiple texturing tools, into the not yet hardened surface of the concrete layer, and with a controller unit for adjusting the travelling speed in the direction of travel, it is provided for the following features to be achieved: the controller unit captures the travelling speed and/or the traversing speed of the texturing device and, during forward or reverse travel, controls the travelling speed and/or the traversing speed of the texturing device in transverse direction in accordance with a specified texturing angle, with the texturing angle ensuing from the relation of the speeds.

12 Claims, 6 Drawing Sheets

(51) Int. Cl.
*E01C 23/09* (2006.01)
*E01C 23/20* (2006.01)
*E01C 19/43* (2006.01)

(52) U.S. Cl.
CPC ..... *E01C 23/028* (2013.01); *E01C 23/09* (2013.01); *E01C 23/20* (2013.01)

(58) Field of Classification Search
CPC ..... E01C 23/088; E01C 23/127; E01C 23/06; E01C 23/08; E01C 11/24; E01C 19/43; E01C 19/22; E01C 19/46; E01C 19/48; E01C 21/00; E02D 3/005; B05B 15/0233; B05B 1/3046; B05B 13/005; B05B 12/124
See application file for complete search history.

(56) References Cited

U.S. PATENT DOCUMENTS 3,801,211 A * 4/1974 Perkins ..... E01C 11/24 404/103
3,850,541 A * 11/1974 Baillet ..... E01C 19/407 404/114
3,874,806 A * 4/1975 Grist ..... E01C 19/43 404/75
4,318,631 A * 3/1982 Vickers ..... E01C 19/43 404/118
6,471,442 B1 * 10/2002 Deeb ..... E01C 19/40 404/105
6,497,531 B2 * 12/2002 Sipherd ..... E01C 23/03 222/526
7,517,171 B2 4/2009 Coats
7,721,831 B2 5/2010 Smolders et al.
8,047,741 B2 11/2011 Von Schönebeck et al.
8,672,581 B2 * 3/2014 Berning ..... E01C 19/004 299/1.5
9,399,842 B2 * 7/2016 Thieme ..... E01C 19/46
2002/0119004 A1 8/2002 Sipherd et al.
2003/0175077 A1 9/2003 Godbersen et al.
2007/0286679 A1 * 12/2007 Coats ..... E01C 19/43 404/93
2008/0292399 A1 * 11/2008 Freeburn ..... E01C 23/088 404/90
2012/0212033 A1 * 8/2012 Bergeron ..... E01C 23/088 299/10

* cited by examiner

TEXTURE CURING MACHINE AS WELL AS METHOD FOR THE SUBSEQUENT TREATMENT OF A FRESHLY PRODUCED CONCRETE LAYER

BACKGROUND OF THE INVENTION

1. Field of the Invention

The invention relates to a texture curing machine, as well as to a method.

2. Description of the Prior Art

Such construction machines are known, for example, from US 2007/0286679 or DE 102011003271 A in the embodiment of a texture curing machine, which can be used to texture a newly produced concrete roadway of a road surface by means of, for example, a brush assembly, and to subsequently spray said concrete roadway with a liquid curing agent by means of a spraying assembly (EP 1841637 A).

During the production of a concrete surface, in particular during the construction of concrete road surfaces, the concrete is generally paved to the required shape and position by a slipform paver and, for this purpose, is smoothed by means of a smoothing device, for example, a transverse smoother. In some cases, a longitudinal smoother is additionally used.

Prior to the application of the curing agent by the texture curing machine, the surface must be given a finishing surface treatment with a surface texture conforming to the intended use. It is thus intended to increase the skid resistance and riding comfort and to reduce the tire roadway noise.

Regarding texturing of the concrete surfaces, clients have different requirements in terms of the type of texture to be applied.

As a result, it may be necessary for the texture curing machines to be converted in a time-consuming procedure in order to achieve a specified texture depending on the client's specification. A further disadvantage is created by the fact that the conversion kits must be kept on hand separately.

DE 10 2011 003 271 A describes a device and a method for creating a grooved texture by means of a cutting drum that is suspended, at a specific angle to the working direction, from a slide that is freely slidable in transverse direction. This design enables the cutting drum, during forward or reverse travel of the machine, to create grooves extending obliquely to the roadway.

By turning the working direction of the cutting drum and reversing the texture curing machine, a second grooved texture can be created, the grooves of which intersect the first grooved texture.

If the machine is reversed or if a different angle of the cutting drum to the working direction is to be adjusted, the cutting drum needs to be raised.

A coordination of speeds is not required.

A texture curing machine is known from U.S. Pat. No. 7,517,171 that enables a texture extending obliquely to the roadway in which the texturing device is arranged on a slide movable transverse to the roadway and the texturing device can be moved forth and back in working direction. The texture curing machine is not moved in the process. A controller coordinates the movement of the slide in transverse direction of the machine with the movement of the texturing element in working direction. This prior art also requires significant equipment-related efforts to perform specific texturing operations. It is of disadvantage in this design that the texturing angle can be altered to a limited degree only.

SUMMARY OF THE INVENTION

It is therefore the object of the invention to create a texture curing machine as well as a method for the subsequent treatment of freshly produced concrete layers which are capable to easily perform different texturing operations without requiring time-consuming conversion times and without requiring extensive equipment-related efforts.

The invention advantageously provides for a controller unit to capture the travelling speed and/or the traversing speed of the texturing device during forward or reverse travel and controls the travelling speed and/or the traversing speed in accordance with a specified texturing angle, with the texturing angle ensuing from the relation of the speeds. The controller can therefore measure the travelling speed and, in accordance with a specified texturing angle, control the traversing speed of the texturing device in transverse direction during the forward or reverse travel or capture the traversing speed of the texturing device and control the travelling speed. In addition, there is the possibility to control both speeds in accordance with the specified texturing angle.

The controller unit can control the travelling speed in case of a predetermined traversing speed of the texturing tools, or control the traversing speed of the texturing tools in case of a predetermined travelling speed.

The controller unit may comprise means for the input of a specified texturing angle.

Detectors can measure the travelling speed of the machine frame in longitudinal direction and the traversing speed of the texturing device in transverse direction and transfer the measured signals to the controller.

The texturing device may be a transverse texturing device and preferably features a fixed length extending in the direction of travel.

The texturing device may also feature an alterable length extending in the direction of travel by means of, for example, attachable extension elements.

The texturing device may also be a longitudinal texturing device, the texturing tools of which are movable in transverse direction at a predeterminable speed.

The texturing tools are preferably replaceable, in which design the spacing of the texturing tools may also be variable.

The texturing tools of a longitudinal texturing device may revolve continuously transverse to the direction of travel.

If the texturing tools are guided continuously in a horizontal plane in which they are permanently engaged with the concrete layer, the front texturing tools as seen in the direction of travel create a texture at a predetermined, positive angle relative to the direction of travel, and the rear texturing tools as seen in the direction of travel create a texture at the same, negative angle relative to the direction of travel.

If the returning texturing tools are returned in raised condition or are guided continuously in a vertical plane or in a plane oblique to the surface of the concrete layer in which they do not touch the concrete layer during the return movement, a purely oblique texturing operation can be performed.

Depending on the service contract, the texture curing machine can thus be controlled, based solely on the control operation without conversion, so as to enable the flexible application of any desired texturing patterns.

A working device movable in transverse direction for the application of a texture may preferably be a transverse texturing device which is movable into a resting position in which the transverse texturing device is disengaged from the concrete layer.

The transverse texturing device is preferably movable to and fro transverse to the working direction on a rail guide which, at no less than one lateral end beyond the width of the concrete layer, features a height offset which raises the transverse texturing device, at said end, into the resting position. In raised position, it is ensured that the transverse texturing device comes in touch neither with the concrete layer nor with any other modules.

In a preferred embodiment, it is intended for the machine frame to comprise longitudinal members extending parallel to the working direction and transverse members extending transverse to the working direction, where the transverse members extending transverse to the working direction are telescopable for variable adjustment of the crawler width of the ground-engaging units and for adjustment to the width of the concrete layer.

It is preferably intended for the working devices to comprise a longitudinal spraying device and/or a transverse spraying device movable to and fro across the working width of the concrete roadway.

It may be intended for the transverse spraying device, in the operating position, to be arranged in the extended axis of the transverse texturing device preferably lagging in working direction or on one side or both sides next to the transverse texturing device and to be movable in conjunction with the transverse texturing device.

The machine frame may be supported by two individual, longer ground-engaging units, each being arranged laterally, or by a total of four ground-engaging units, in which design two ground-engaging units running behind one another may be arranged on each side of the machine frame. The ground-engaging units are connected to the machine frame via lifting columns which enable a height adjustment of the machine frame to be performed relative to the ground surface.

It is preferably intended for the transverse or longitudinal texturing devices to comprise tools which are attached by means of a quick-change system. It is thus possible to exchange the tools without the need for extended setup times or to exchange defective tools without incurring a significant time loss.

According to a method for the subsequent treatment of freshly produced concrete layers, the invention advantageously provides for the travelling speed and/or the traversing speed of the texturing device to be captured and for the travelling speed and/or the traversing speed of the texturing device to be controlled in transverse direction during forward or reverse travel in accordance with a specified texturing angle, with the texturing angle ensuing from the relation of the speeds.

It is preferably intended for the travelling speed to be controlled in case of a predetermined traversing speed of the texturing tools, or for the traversing speed of the texturing tools to be controlled in a relation predetermined by the texturing angle adjusted in case of a predetermined travelling speed.

Applying a transverse texture across a section of predetermined length in one direction of travel and subsequently across a following further section of the same length in an opposite direction of travel enables successive textures to be applied, at a texturing angle, into the concrete layer in the same direction.

In the following, embodiments of the invention are explained in more detail with reference to the drawings.

BRIEF DESCRIPTION OF THE DRAWINGS

The following is shown.

DETAILED DESCRIPTION

Figure 1:
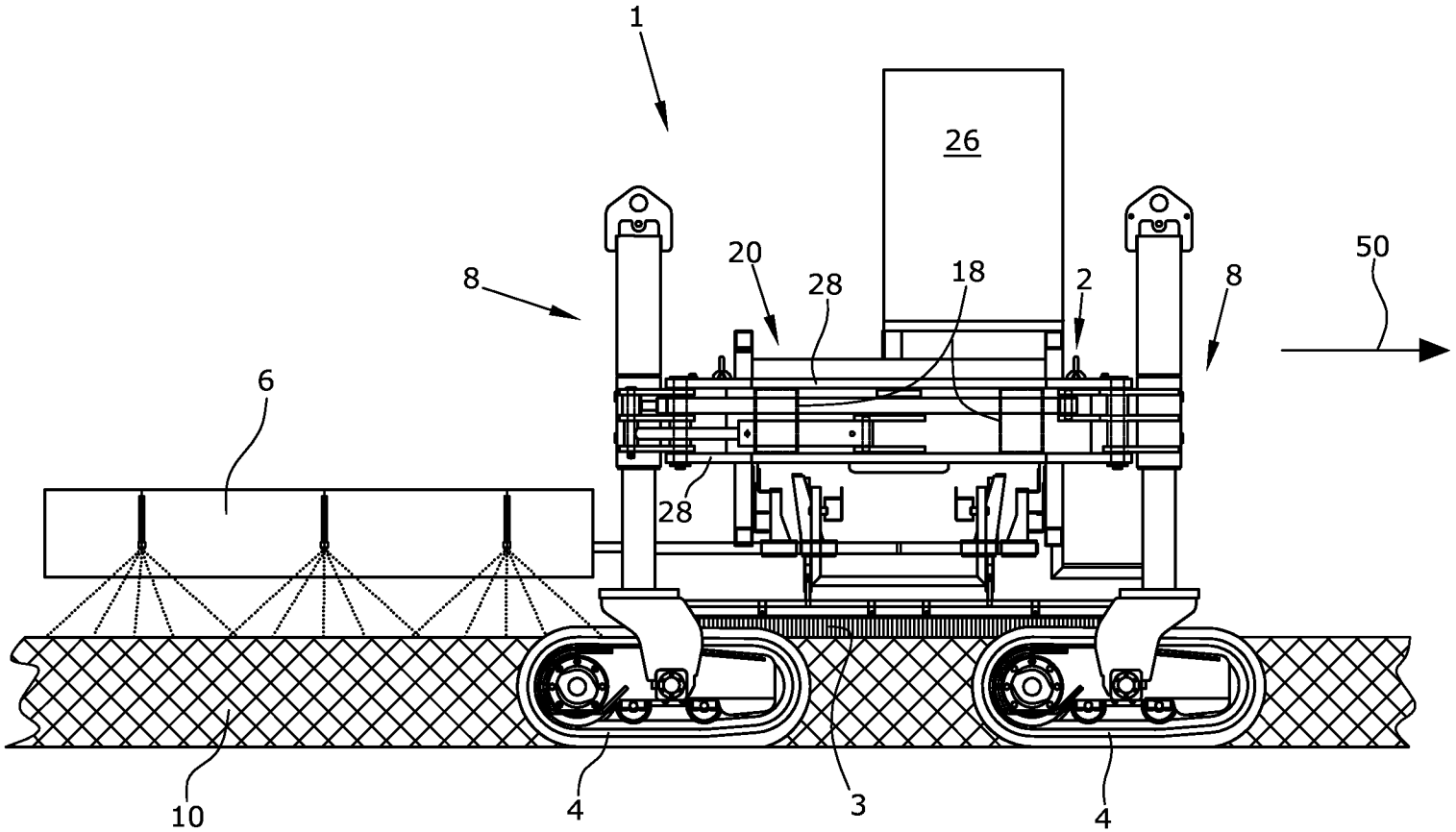
FIG. 1 a texture curing machine in accordance with prior art.

FIG. 1 shows, in a schematic illustration, a texture curing machine 1 in the embodiment of a brush spraying machine as it is known from EP 1 841 637 A. The texture curing machine 1 can texturize a newly produced concrete layer 10, such as a road surface, by means of a transverse texturing device 3, for example, a brush assembly, and subsequently spray said concrete layer with a liquid curing agent by means of a spraying assembly.

The machine frame 2 features a depth suitable for transport on a transport vehicle so that the machine can be transported to the operating site by road on the transport vehicle. The machine frame comprising transverse and longitudinal members 18, 28 features a multiple of the width in comparison to the depth with, for example, widening elements being insertable or the machine frame 2 being telescopable for adjustment to a specific roadway width. In this arrangement, a roadway width of, for example, up to 18 m can be bridged in the working position shown in FIG. 1. The working direction is indicated in each of the drawings by an arrow 50.

The texture curing machine 1 comprises a chassis with multiple wheels and/or crawler units 4 which support the machine frame 2 in a height-adjustable manner via lifting columns 8.

The use of a total of four ground-engaging units 4 at the lateral ends of the texture curing machine 1 has the advantage of higher stability, with the arrangement of the working devices, in particular the texturing devices 3, centrally between the ground-engaging units 4 as seen in the direction of travel 50 offering the advantage of the influence of forces of mass inertia on the machine frame 2 being minimized when starting or braking the texture curing machine 1. Moreover, slight pitching movements occurring nonetheless have a less pronounced effect on the position of the texturing device relative to the concrete surface.

The wheels or crawler units 4 can, in particular in the case of four crawler units 4, be transferred from a working position shown in FIG. 1 into a transport position by means of a swivel gear. In working position, as shown in FIG. 1, the crawler units 4 extend parallel to longitudinal members 28 of the machine frame 2. In transport position, the crawler units 4 extend parallel to the longitudinal extension of the machine frame 2, namely, pivoted about 90° and transverse to the longitudinal members 28.

The crawler units 4 are hydraulically driven, steerable and adjustable in height.

Figure 2:
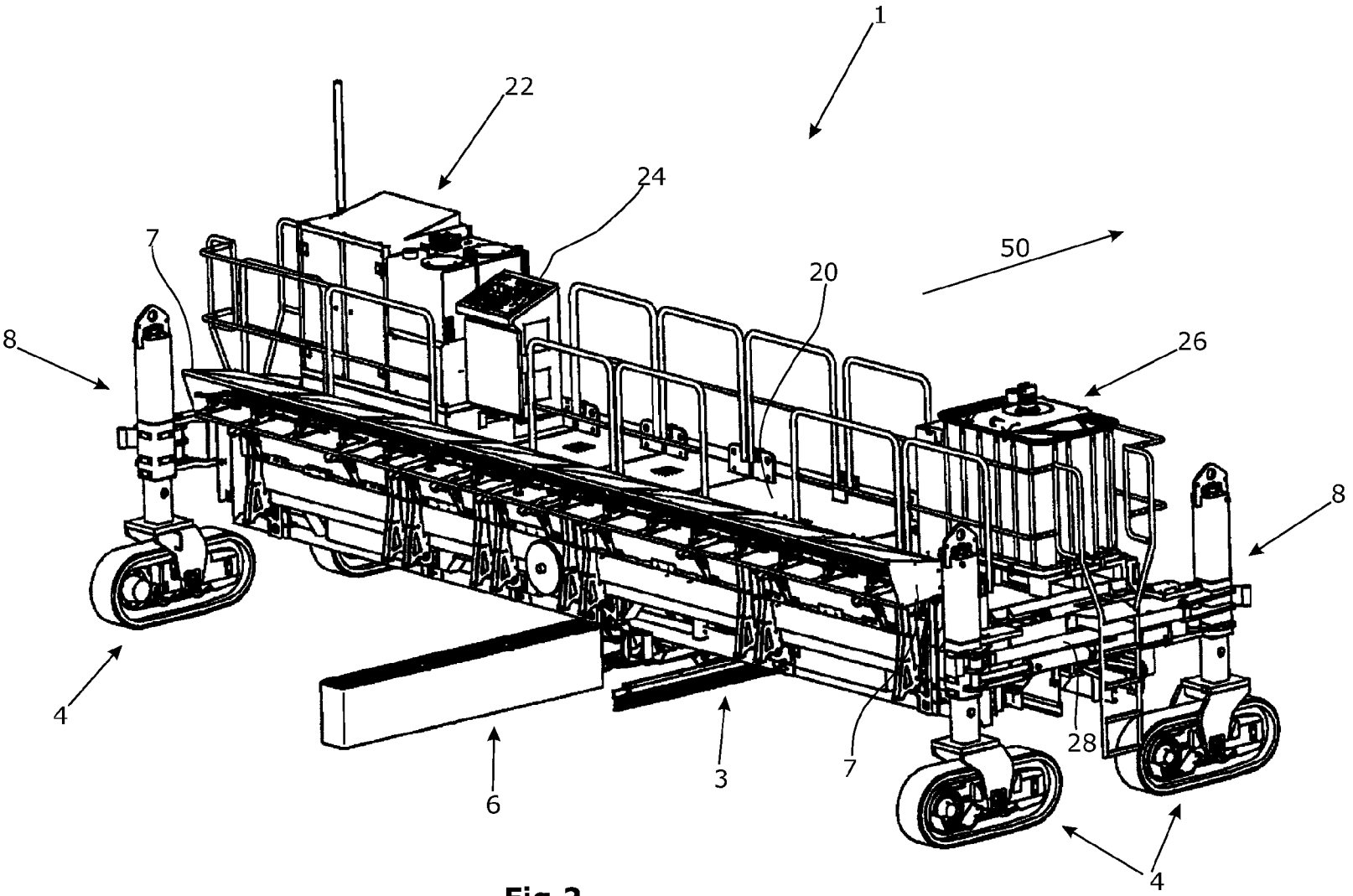
FIG. 2 a perspective view of the texture curing machine in accordance with FIG. 1, FIG. 3 a transverse texturing device movable in transverse direction with coordinated speeds of the texture curing machine and transverse texturing device, FIG. 4 the embodiment of FIG. 3 after completion of the transverse movement of the transverse texturing device, FIG. 5 the advance movement of the texture curing machine after completion of the first texturing section produced during forward travel, FIG. 6 the production of the second texturing section during reverse travel of the texture curing machine, FIG. 7 the completion of the second texturing section, FIG. 8 the advance movement of the texture curing machine after completion of the second texturing section, and FIG. 9 an embodiment of a longitudinal texturing device with texturing tools movable in transverse direction.

FIG. 2 shows a perspective view of the texture curing machine 1. The drive unit 22 comprising a control panel with a controller unit 24 is arranged on the left side as seen in the direction of travel 50. Both are arranged on a platform 20 of the machine frame 2, said platform being walkable and comprising, on its side opposite the drive unit 22, a spraying agent tank 26.

As in the prior art, the transverse spraying device 6 is attached at a transverse drive movable crosswise over the concrete layer 10 or the roadway width, respectively. Furthermore, the transverse texturing device 3 comprised of, for example, a brush assembly, is also attached at the transverse drive. In this arrangement, as can best be inferred from FIG. 3*a*, the transverse texturing device 3 is guided across the width of the concrete layer 10 in a rail-guided slide provided with a transverse drive.

To this effect, the rail guide of the slide is raised by a predetermined magnitude in a section laterally next to the concrete layer 10 so that the transverse texturing device 3 can be transferred into a raised condition next to the concrete layer 10 or roadway respectively, into a resting position.

The transverse spraying device 6, as depicted in FIG. 2, is attached at the transverse drive in a removable fashion. It can thus be loosened from the transverse drive when converting to a longitudinal spraying device 7. A longitudinal spraying device 7 in a folded-up, deactivated condition is shown in FIG. 2.

Figure 3:
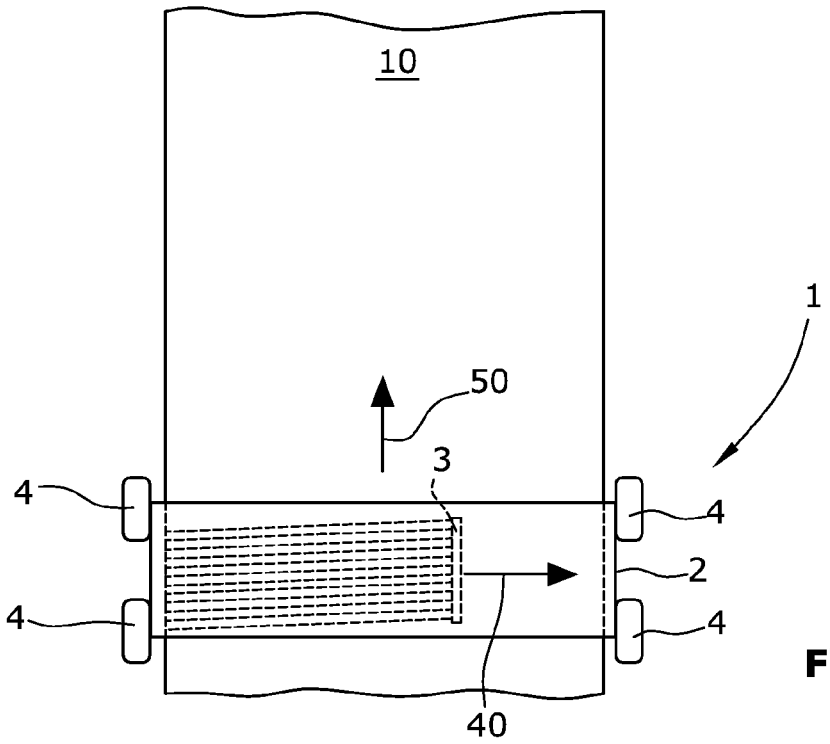

FIG. 3 shows a first embodiment of the invention in which the transverse texturing device 3 extends parallel to the direction of travel 50 and is comprised of, for example, a brush assembly or a different transverse texturing device comprising texturing tools 30 protruding vertically downwards, such as rigid pins. The transverse texturing device 3 is arranged approximately centrally between the front and rear crawler units 4 and is movable, between two end positions, transverse to the direction of travel. During said transverse movement, the transverse texturing device maintains its alignment parallel to the working direction 50. The direction of transverse movement 40 is orthogonal to the direction of travel 50, with the texture curing machine 1 being movable forward or backward during the texturing operation. FIG. 3 therefore shows a texturing operation in which the transverse texturing device 3 is moved to the right during forward travel of the texture curing machine 1. The forward advance speed in the direction of travel 50 and the transverse drive speed of the transverse texturing device can be coordinated by means of the controller unit 24 so that an adjustable texturing angle ensues from the relation of the speeds.

If a constant texturing angle is specified for the entire width of the concrete layer 10, a specific relation between the travelling speed of the texture curing machine 1 and the speed of transverse movement of the transverse texturing device is adjusted in the controller unit 24. It is understood that the speed of transverse movement of the transverse texturing device 3 can be adjusted in accordance with the travelling speed of the texture curing machine 1, or vice versa.

The travelling speed of the transverse drive for the transverse texturing device 3 may, for example, simply be captured by stops for the transverse texturing device 3 on the left and right side of the texture curing machine 1 by measuring the duration of time for the transverse movement across the width of the concrete layer 10.

It goes without saying that data from the transverse drive can also be used to determine the speed in the direction of transverse movement 40.

Lastly, it is also possible to control both the travelling speed and the transverse speed of the transverse texturing device jointly in accordance with the texturing angle adjusted.

As a result of the relation of speeds also being alterable during the transverse texturing operation, it is finally also possible to apply a texturing pattern into the concrete layer 10 at different texturing angles.

Figure 4:
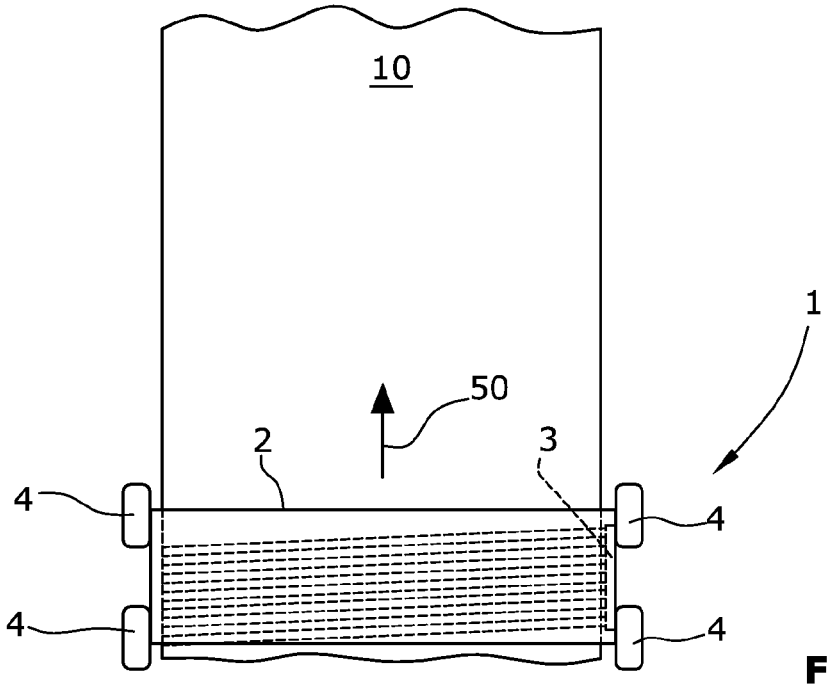

FIG. 4 shows the completion of a first texturing section after the transverse texturing device 3 has fully crossed the concrete layer 10.

Figure 5:
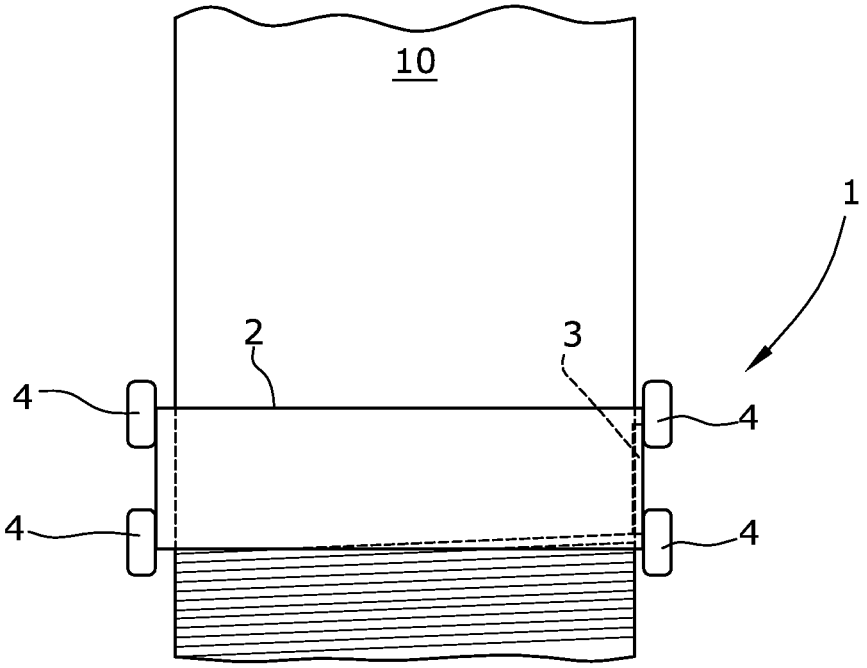
Figure 6:
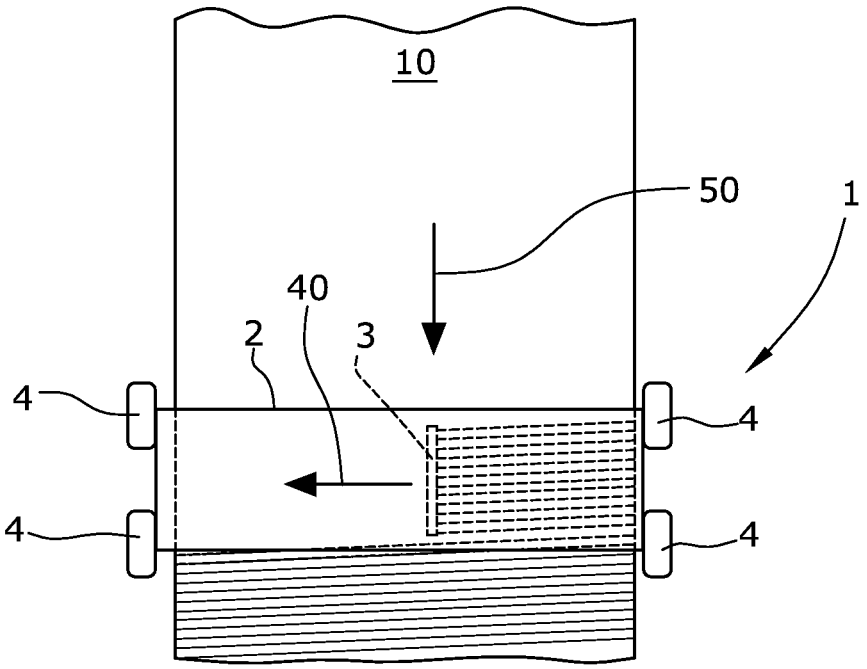

There is then the possibility for the texture curing machine to advance by the length of the transverse texturing device 3 (FIG. 5) and, as can be inferred from FIG. 6, to produce the next texturing section during reverse travel, said second texturing section extending parallel to the first, previously completed texturing section.

In this design, the controller unit can be configured so that, after completion of a texturing section, the machine is driven forward automatically by a travel distance corresponding to the length of the texturing device.

Figure 7:
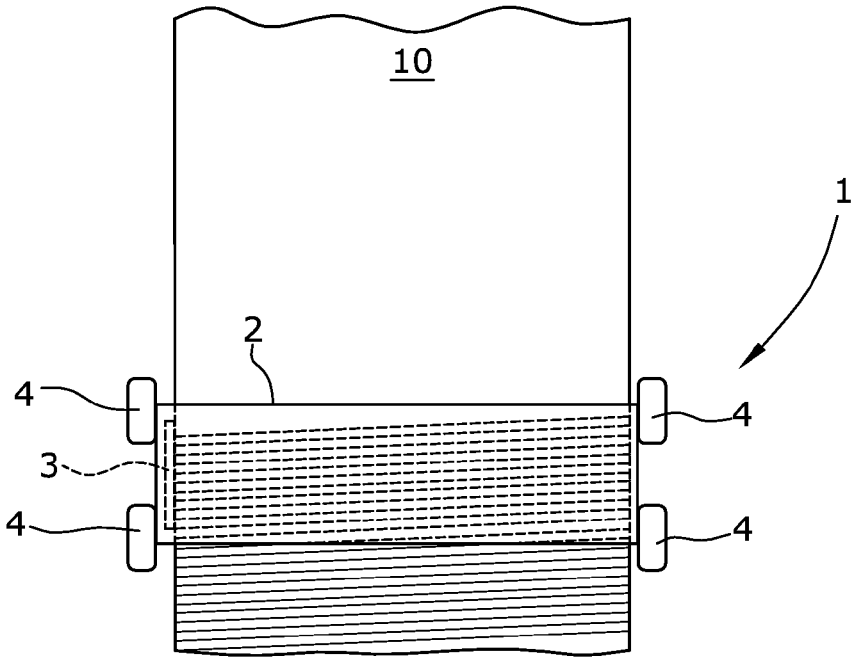
Figure 8:
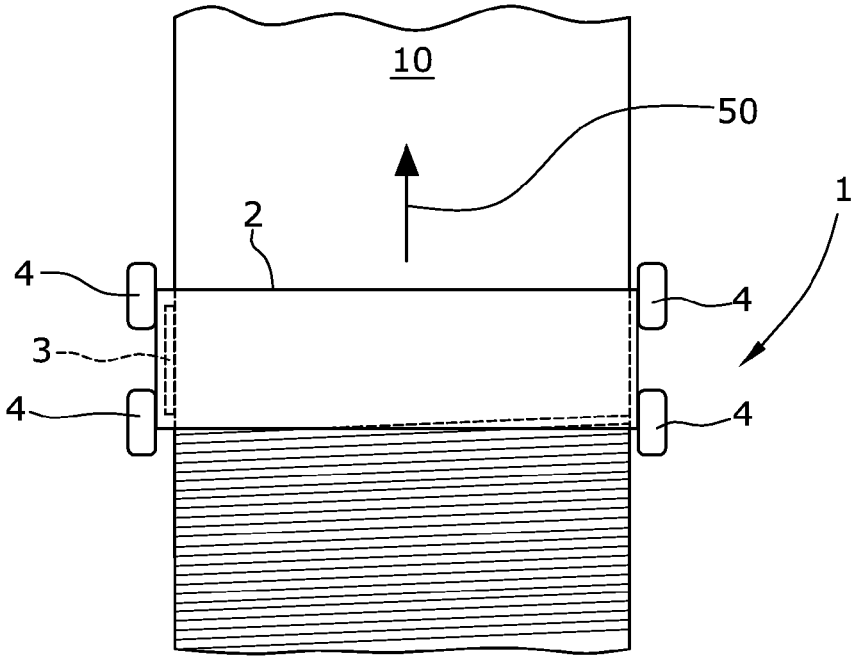

FIG. 7 shows the situation in which the second texturing section has been completed, and FIG. 8 shows the situation in which the texture curing machine 1 drives forward once more by the length of the transverse texturing device 3 in order to create the next texturing section. It is understood that the texture may also be superimposed in that the texturing sections are driven over repeatedly, and namely, at a different texturing angle so that, for example, rhombic patterns can be created.

Figure 9:
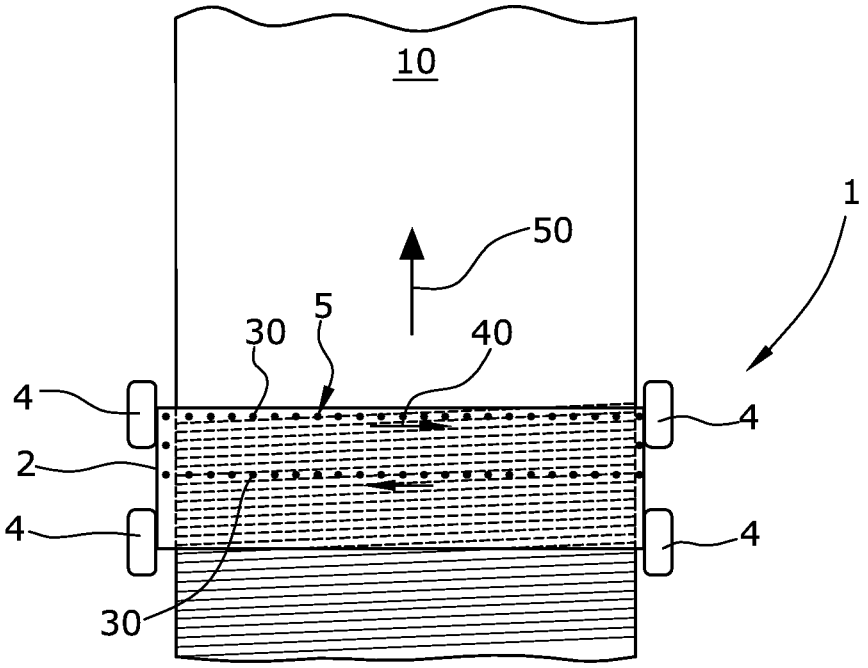

FIG. 9 shows an embodiment comprising a longitudinal texturing device in which the texturing tools 30 protruding in the direction of the concrete layer 10 are moved continuously in the direction of transverse movement 40. In this arrangement, the longitudinal texturing device 5 extends across the entire width of the concrete layer 10 transverse to the direction of travel 50. The texturing tools 30 can be returned laterally outside the concrete layer 10. The texturing tools 30 may, for example, in a different embodiment not inferable from FIG. 9, also revolve in a vertical plane so that the returning texturing tools 30 are disengaged from the concrete layer 10.

In case of the texturing tools 30 moving in a horizontal plane, the returning texturing tools 30 pass through the concrete layer 10 once again in opposite direction so that, in the case of continuous forward travel of the texturing curing machine 1, a rhombic pattern can be created by means of the longitudinal texturing device.

If the texturing tools 30 run in a plane extending obliquely to the surface of the concrete layer 10, there is the possibility to cause the texturing tools 30 moved in a transverse direction only to engage with the concrete layer 10 while the texturing tools 30 returning in opposite direction may be disengaged from the concrete layer 10.

The texturing devices may comprise a quick-change device for tools so that different brushes or tools, such as steel tines or synthetic brushes, can be used within a short period of time.

The invention claimed is:

1. A texturing machine for the subsequent treatment of a freshly produced concrete layer, the texturing machine comprising:

a machine frame;

a plurality of ground-engaging units configured to support the machine frame from a ground surface for travel in a working direction;

at least one texturing device supported from the machine frame and movable relative to the machine frame transverse to the working direction, the at least one texturing device including a plurality of texturing tools configured to apply a texture into the not yet hardened surface of the concrete layer; and a controller unit configured to:

detect a travelling speed of the machine frame in the working direction;

detect a traversing speed of the at least one texturing device transverse to the working direction relative to the machine frame; and control at least one of the travelling speed and the traversing speed to produce a specified texturing angle resulting from a relationship between the travelling speed and the traversing speed.

2. The texturing machine of claim 1, wherein:

the controller unit is configured such that for a predetermined speed of one of the travelling speed and the traversing speed, the controller unit controls the other of the travelling speed and the traversing speed.

3. The texturing machine of claim 1, further comprising:

an input configured to input the specified texturing angle into the controller unit.

4. The texturing machine of claim 1, further comprising:

a travelling speed detector configured to detect the travelling speed of the machine frame in the working direction and provide a travelling speed signal; and a traversing speed detector configured to detect the traversing speed of the at least one texturing device relative to the machine frame and provide a traversing speed signal; and wherein the controller unit is configured to receive the speed signals from the detectors.

5. The texturing machine of claim 1, wherein:

the at least one texturing device is either a transverse texturing device or a longitudinal texturing device, and the texturing tools are movable transverse to the machine frame at a predetermined speed.

6. The texturing machine of claim 5, wherein:

the at least one texturing device is a longitudinal texturing device, and the texturing tools revolve continuously transverse to the working direction.

7. The texturing machine of claim 6, wherein:

the texturing tools of the longitudinal texturing device revolve continuously in a horizontal plane such that a front group of the texturing tools create a texture at a predetermined positive angle relative to the working direction, and a rear group of the texturing tools create a texture at an equal negative angle relative to the working direction.

8. A texturing machine for the subsequent treatment of a freshly produced concrete layer, the texturing machine comprising:

a machine frame;

a plurality of ground-engaging units configured to support the machine frame from a ground surface, the ground-engaging units including travelling drives for moving the machine frame forward and backward in a working direction;

a texturing device supported from the machine frame and including a plurality of texturing tools configured to apply a texture into a not yet hardened surface of the concrete layer;

a transverse drive configured to move the texturing tools of the texturing device transversely relative to the machine frame; and a controller unit, including:

a travelling speed sensor configured to detect a travelling speed of the machine frame in the working direction;

a traversing speed sensor configured to detect a traversing speed of the texturing device transverse to the working direction;

an input configured to input a specified texturing angle into the controller unit; and a controller operatively connected to the sensors and to the travelling drives and the transverse drive, the controller being configured to receive speed signals from the sensors and to control the travelling drives and the transverse drive so that a relationship of the travelling speed to the traversing speed corresponds to the specified texturing angle.

9. The texturing machine of claim 8, wherein:

the texturing device is a longitudinal texturing device, and the texturing tools are continuously movable in a transverse direction.

10. The texturing machine of claim 9, wherein:

the texturing tools are arranged in an endless loop such that the texturing tools revolve continuously along the endless loop.

11. The texturing machine of claim 10, wherein;

the endless loop of texturing tools run in a plane extending obliquely to the surface of the concrete layer, such that returning texturing tools are disengaged from the concrete layer.

12. The method of claim 8, wherein:

the texturing tools are arranged in an endless loop in a horizontal plane such that the texturing tools revolve about the loop continuously, essentially transverse to the working direction, with a first texture being created at a positive specified texturing angle relative to the working direction by a front group of texturing tools, and with a second texture being created at an equal negative angle relative to the working direction by a rear group of the texturing tools.

* * * * *